US009191769B2

(12) United States Patent
Congard

(10) Patent No.: US 9,191,769 B2
(45) Date of Patent: Nov. 17, 2015

(54) METHOD AND A DEVICE FOR REPRODUCING LOW FREQUENCY SOUND IN A RECTANGULAR ROOM

(71) Applicant: ANAGRAM-ACOUSTICS, Paris (FR)

(72) Inventor: Patrice Congard, Paris (FR)

(73) Assignee: ANAGRAM-ACOUSTICS, Paris (FR)

( * ) Notice: Subject to any disclaimer, the term of this patent is extended or adjusted under 35 U.S.C. 154(b) by 49 days.

(21) Appl. No.: 14/365,001

(22) PCT Filed: Dec. 13, 2012

(86) PCT No.: PCT/FR2012/052925

§ 371 (c)(1),
(2) Date: Jun. 12, 2014

(87) PCT Pub. No.: WO2013/088081

PCT Pub. Date: Jun. 20, 2013

(65) Prior Publication Data

US 2014/0348356 A1 Nov. 27, 2014

(30) Foreign Application Priority Data

Dec. 13, 2011 (FR) ..... 11 03822

(51) Int. Cl.
*H04R 5/02* (2006.01)
*H04S 7/00* (2006.01)

(52) U.S. Cl.
CPC ..... *H04S 7/307* (2013.01); *H04S 7/301* (2013.01); *H04S 7/305* (2013.01); *H04S 2400/05* (2013.01)

(58) Field of Classification Search
CPC ..... H04S 7/307; H04S 7/305; H04S 2400/05; H04S 7/301
USPC ..... 381/303
See application file for complete search history.

(56) References Cited

U.S. PATENT DOCUMENTS

| | | | | |
|---|---|---|---|---|
| 2,983,790 | A | 5/1961 | Olson | |
| 6,519,344 | B1 | 2/2003 | Yajima et al. | |
| 2003/0099365 | A1 * | 5/2003 | Karjalainen | H04S 7/302 381/61 |
| 2008/0247552 | A1 | 10/2008 | Herzog | |

FOREIGN PATENT DOCUMENTS

FR 2890480 3/2007

OTHER PUBLICATIONS

Rumsey et al.: "Multichannel surround sound systems and operations"; AES Technical Committee on Multichannel and Binaural Audio Technology, Jan. 2001, XP055041239, http://www.aes.org/technical/documents/AFSTD1001.pdf (28 pages).

Toole: "Chapter 13 Making (Bass) Waves—Below the Transition Frequency" In: "Sound Reproduction", The Acoustics and Psychoacoustics of Loudspeakers and Rooms, Jan. 2008, Focal Press, XP055040887, (6 pages).

* cited by examiner

*Primary Examiner* — Paul S Kim

(74) *Attorney, Agent, or Firm* — Hamre, Schumann, Mueller & Larson, P.C.

(57) ABSTRACT

For reproducing sound in a rectangular room in association with a video playback screen (10), from audio signals of the kind comprising at least three main channels (2, 3, 4) and a bass effects channel (1), at least five loudspeakers (11, 12, 13, 14, 15) are used that are specialized for reproducing audio frequencies lower than 120 Hz, four of which (11, 13, 14, 15) are arranged in four respective corners of the room and at least one of them (12) is arranged in the proximity of the screen. The two loudspeakers (14, 15) arranged in the corners furthest away from the screen receive either a signal constituted by the sum of the signals for the other loudspeakers with polarity inversion, with individual delays, and with lowpass filtering, or else a signal coming from a microphone (23, 25) arranged in the immediate proximity of each of the two loudspeakers (14, 15) concerned, the microphone signal being inverted in polarity and lowpass filtered.

10 Claims, 3 Drawing Sheets

METHOD AND A DEVICE FOR REPRODUCING LOW FREQUENCY SOUND IN A RECTANGULAR ROOM

The field of the present invention is that of reproducing sound from multiple signal channels. Such audio signals are generally associated with images of the kind produced by the cinema or by video recordings.

Conventionally, these audio signals are reproduced by a plurality of loudspeakers having amplifier means, and associated together with a screen on which cinema or video images are reproduced.

More precisely, the audio signals are generally distributed among six or eight channels comprising three main channels providing individual signals that may cover the entire audio frequency spectrum (20 hertz (Hz) to 20 kilohertz (kHz)), two or four so-called "effects" channels, and a bass effects channel reproducing a frequency spectrum limited to frequencies below a determined cutoff frequency, usually lying in the range 80 Hz to 120 Hz.

Signals of frequency higher than said cutoff frequency are reproduced by unspecialized loudspeakers. Since the number of these loudspeakers is generally five or seven, it is preferable to use loudspeakers that are small in size, for reasons of appearance and also for ease of placing them in the room. Such loudspeakers are generally poorly adapted to reproducing the lowest frequencies of the audio frequency spectrum.

In conventional manner, the signals of the three main channels are filtered using a highpass function at said cutoff frequency in order to drive the unspecialized loudspeakers, and a loudspeaker that is specialized for low frequencies is driven by the sum of the signals from the three main channels after being filtered with a lowpass function at said cutoff frequency. The signal coming from the bass effects channel is also added to this sum of filtered signals.

The signals from the two or four "effects" channels generally contain very little low frequency content, and reproduction of these frequencies on these channels is usually not critical.

A first drawback associated with such devices is that the sum of the main signals is not phase correlated, nor is it aligned in time with the bass effects signal, which signal is recorded separately.

This results in incoherence in the sum of the signals that are to be reproduced by the loudspeaker that is specialized for low frequencies, thereby leading to a loss in overall quality.

A second drawback of such devices is that such a loudspeaker specialized for low frequencies excites standing waves in the room in a manner that varies depending on where it is positioned. These standing waves create frequency responses that are very irregular and variable depending on the position of the listener in the room.

A partial solution has been found to this second drawback: the number of loudspeakers specialized for low frequencies is increased and they are placed in various locations in the room so as to reduce the irregularities and variations in the frequency responses. All of those loudspeakers are driven by the same signal, sometimes with an individual time delay for each loudspeaker in order to take account of its position in the room.

That solution is only partially satisfactory and it is very difficult to implement.

The object of the present invention is to provide a device and a method of implementing said device for reproducing sound at low frequencies, lower than said cutoff frequency, while avoiding the above-described drawbacks.

The device of the present invention is generally for use with a screen which may be a screen onto which images are projected, or a screen for playing back images directly.

The invention provides a method of reproducing low frequency sound in a rectangular room for reproducing sound from audio signals via at least three "main" channels and a "bass effects" channel in association with a video playback screen, which method comprises using at least five loudspeakers specialized for reproducing audio frequencies lower than 120 Hz, placing four loudspeakers selected from said at least five loudspeakers in four respective corners of said rectangular room, and placing at least one loudspeaker selected from said at least five loudspeakers in the proximity of said video playback screen, the method being characterized by selecting from said four loudspeakers first and second loudspeakers that are arranged in corners of said rectangular room that are furthest away from said video playback screen and either adapting said first and second loudspeakers in such a manner that they receive a signal constituted by the sum of the signals for the other loudspeakers but with inverted polarity, with individual delays, and lowpass filtering, or else each of said first and second loudspeakers is adapted to receive a signal coming from a respective microphone arranged in its immediate proximity, said signal being polarity inverted and lowpass filtered.

In a preferred implementation, said first and second loudspeakers have a resonant frequency greater than 120 Hz, e.g. a resonant frequency of approximately 150 Hz.

In another possible implementation, said first and second loudspeakers have a resonant frequency lower than 20 Hz.

Said first and second loudspeakers are advantageously of closed type.

In a particular aspect of the present invention, said third and second loudspeakers are selected from among said four loudspeakers, the third and fourth loudspeakers being arranged in corners of said rectangular room that are the closest to said video playback screen, and said third and fourth loudspeakers are adapted to receive a "low frequency effects" signal in its initial polarity and do not receive left, center, or right signals.

In another particular aspect of the present invention, said at least one loudspeaker arranged in the proximity of said video playback screen is adapted in such a manner as to receive a lowpass filtered signal constituted by the sum of the left, center, and right main signals and not to receive the "low frequency effects" signal.

The invention also provides a device for reproducing low frequency sound in a rectangular room for reproducing sound from audio signals via at least three "main" channels and a "bass effects" channel in association with a video playback screen, which method comprises using at least five loudspeakers specialized in reproducing audio frequencies lower than 120 Hz, four loudspeakers selected from said at least five loudspeakers being arranged respectively in four corners of said rectangular room, and at least one loudspeaker selected from said at least five loudspeakers being arranged in the proximity of said video playback screen, the device being characterized in that first and second loudspeakers that are arranged in corners of said rectangular room that are the furthest away from said video playback screen are selected from said four loudspeakers, which first and second loudspeakers are adapted either to receive a signal constituted by the sum of the signals allocated to the other loudspeakers with polarity inversion, with individual delays, and with lowpass filtering, or else are adapted so that each of them receives a signal coming from a respective microphone arranged in its immediate proximity, said signal being polarity inverted and lowpass filtered.

In a particular aspect, third and fourth loudspeakers that are arranged in corners of said rectangular room that are the closest to said video playback screen are selected from among said four loudspeakers, which third and fourth loudspeakers are adapted so that they receive a "low frequency effects" signal with its initial polarity and they do not receive left, center, or right signals.

In another particular aspect, said at least one loudspeaker arranged in the proximity of said video playback screen is adapted in such a manner as to receive a lowpass filtered signal constituted by the sum of the left, center, and right main signals and does not receive a "low frequency effects" signal.

In use of the method and the device of the invention, said at least one loudspeaker arranged in the proximity of the screen receives a lowpass filtered signal from any one of the "main" channel signals or from the sum of two or three of these signals.

The characteristics and advantages of the present invention appear from the description given below of embodiments of the invention given as non-limiting examples and with reference to the accompanying figures, in which.

Figure 1:
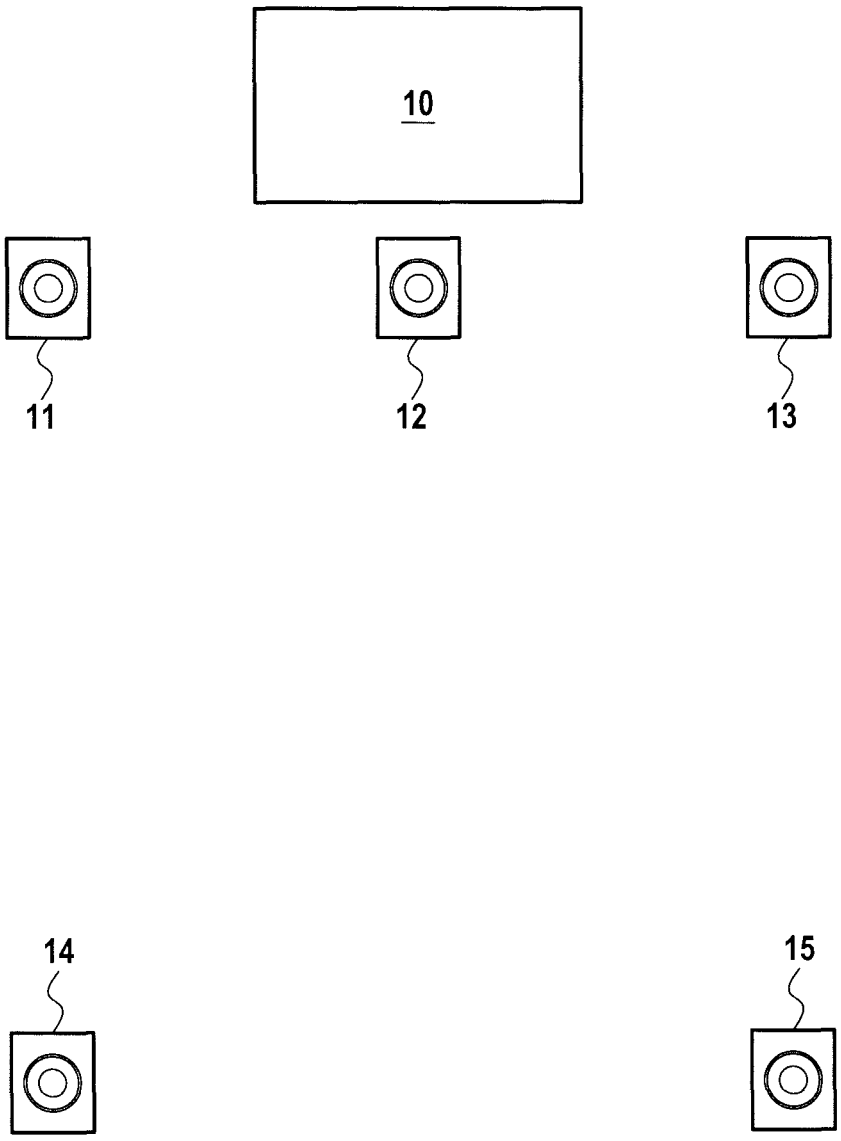
FIG. 1 is a symbolic view of a device of the invention.

In greater detail, with reference to FIG. 1, a projection screen 10 is provided in a room. In an alternative, it may be an active play-back screen. Five loudspeakers 11, 12, 13, 14, and 15 are also provided in the room.

The loudspeakers 11, 12, 13, 14, and 15 are of a type that is specially for reproducing the lowest frequencies of the audio spectrum, i.e. in the range 20 Hz to 120 Hz. These loudspeakers may all be of the same type, however they may also be of different types. They comprise at least one loudspeaker suitable for reproducing the lowest frequencies of the audio spectrum, an acoustic box, and amplifier means.

Figure 2:
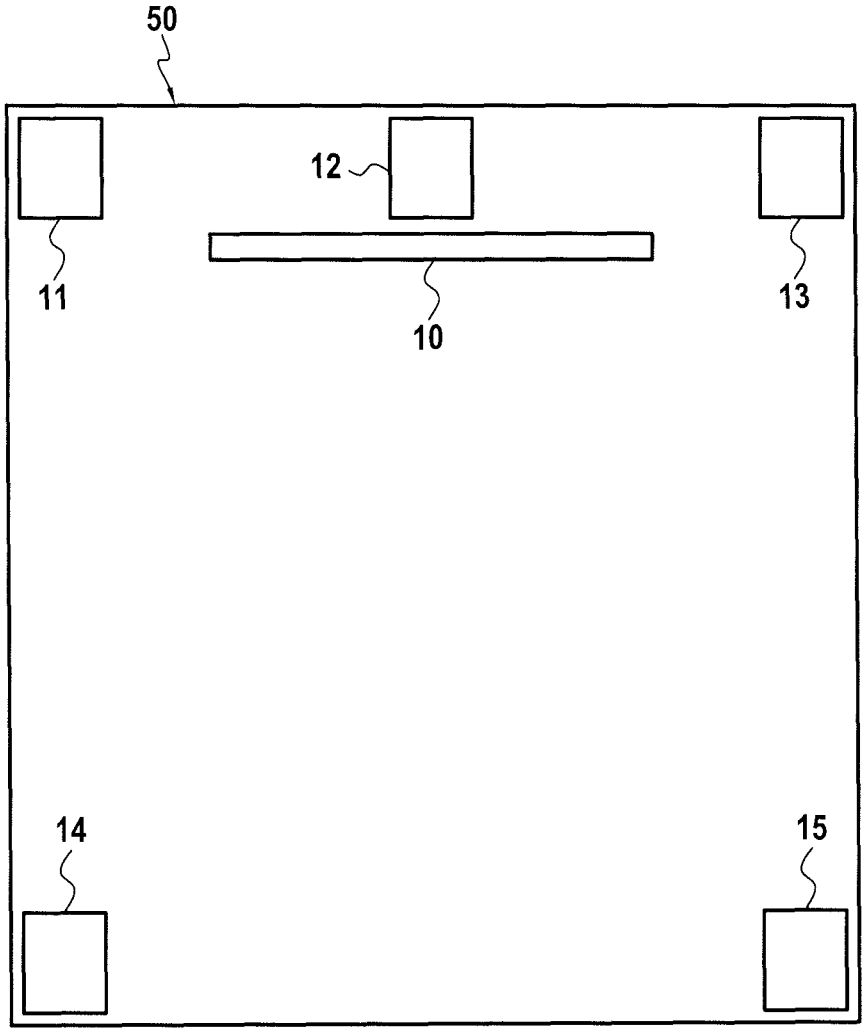
FIG. 2 is a plan view showing the arrangement of a device of the invention in a room.

The loudspeakers 11, 13, 14, and 15 are arranged at the four corners of the room 50 (FIG. 2), said room 50 being shown as being rectangular in shape. In practice, the loudspeakers 11, 13, 14, and 15 are arranged very close to the walls forming corners and they stand on the ground. By "very close to the walls", it should be understood that they are spaced apart from the walls by a distance of less than half the smallest dimension of each loudspeaker, although this criterion is not limiting.

The loudspeaker 12 is arranged between the loudspeakers 11 and 13, and it is close to the screen 10. In the drawing, the loudspeaker 12 is shown as being at substantially equal distances from the loudspeakers 11 and 13, but that is not necessarily so. In practice, it is desirable for the loudspeaker 12 to be at a distance from the screen 10 that is less than approximately 94 centimeters (cm), which constitutes one-fourth of the wavelength at the highest envisaged cutoff frequency, i.e. 120 Hz.

Figure 3:
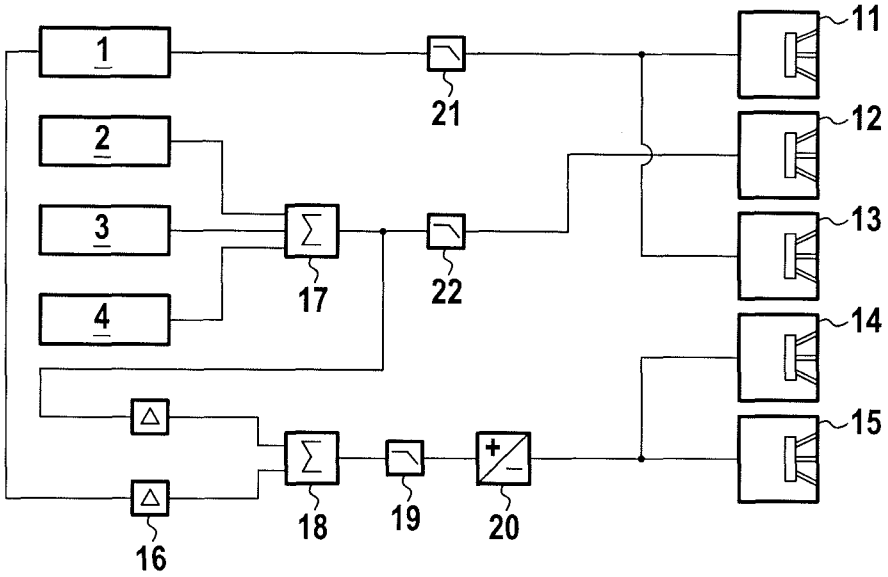
FIG. 3 is a diagram showing the various connections of a device of the invention in a first embodiment.

With reference to FIG. 3, the signal 1 is a bass effects signal. During recording, this signal 1 is processed separately from the others, and it is for creating impressions associated with the program of images being played back. Since it is limited to bass frequencies and since it is for creating impressions, although it is in association with the images, it need not necessarily be genuinely synchronized with those images.

The bass effects signal 1 is filtered using a lowpass function at the cutoff frequency by means of a filter 21, and it drives simultaneously the loudspeakers 11 and 13 specialized in reproducing low frequencies.

The signals 2, 3, and 4 are said to be "main" signals. These are audio signals synchronized with the images on the screen: the sound must correspond in believable manner with the action of the projected film or video.

The signals 2, 3, and 4 conventionally drive conventional loudspeakers (not shown) capable of reproducing most of the frequencies contained in said signals. Reproducing the lowest frequencies gives rise to constraints of cost, size, and positioning in the room that are generally undesirable. To escape from these constraints, loudspeakers are used that are suitable for reproducing frequencies higher than the cutoff frequency, and they are driven from signals that have been filtered with a highpass function at the cutoff frequency, which signals are derived from the signals 2, 3, and 4.

The use of such loudspeakers and the practice of driving them with signals that have been filtered with highpass functions are in themselves known and do not constitute the subject matter of the invention.

In the invention, frequencies lower than the cutoff frequency and contained in the signals 2, 3, and 4 are reproduced as follows: the signals 2, 3, and 4 are summed with the help of a summing device 17. The sum of the signals 2, 3, and 4 is then filtered with a lowpass function by the filter 22, which then drives the loudspeaker 12 that is specialized for reproducing low frequencies.

The bass effects signal 1 and the sum of the main signals 2, 3, and 4 are also delayed by means of a two-channel delay device 16 that enables these two signals to be delayed individually. Thereafter, these two delayed signals are summed with the help of a summing device 18, and then the resulting signal is filtered with a lowpass function with the help of a filter 19.

Thereafter, the polarity of the resulting signal is inverted with the help of a polarity inverter device 20. The signal as inverted in this way then drives the loudspeakers 14 and 15, which are provided with respective amplifier means, each having its own level adjustment.

The delays applied to the signal 1 and to the sum of the signals 2, 3, and 4 are adjusted by the delay device 16 as follows: the delay applied to the signal 1 corresponds to the time taken by sound to propagate between the loudspeakers 11 and 14, and the delay applied to the sum of the signals 2, 3, and 4 corresponds to the time taken by sound to propagate between the loudspeakers 12 and 14.

The delay applied to the sum of the signals 2, 3, and 4 corresponds to the time taken by sound to propagate between the loudspeakers 12 and 14.

The configuration of the loudspeakers is preferably symmetrical relative to the axis of the room 50 so as to avoid any difference between the propagation time of sound between the loudspeakers 11 and 14 and the propagation time of sound between the loudspeakers 13 and 15.

This constraint could be overcome by driving the loudspeakers 14 and 15 with two individual signals each constituted by the sum of the signals 1 and the sum of the signals 2, 3, and 4, as filtered and delayed individually so as to compensate for the difference between the distance between the loudspeakers 12 and 14 and the distance between the loudspeakers 12 and 15.

The delay device 16, the summing device 18, and the filter 19 preferably form part of a single device for digitally processing the signal.

The above-described device is used as follows: with the help of a spectrum analyzer, the test signal provided by said analyzer is used to drive any one of the signals 2, 3, or 4. Sound pressure in the immediate proximity of the loudspeaker 14 is measured. The distance between the measurement microphone and the loudspeaker must be less than half the minimum dimension of the loudspeaker, and said microphone must be placed in front of the sound-emitting portion of the loudspeaker. The level of the loudspeaker 14 is adjusted while simultaneously adjusting the time delay applied by the delay device 16 so that said sound pressure is at a minimum in the range 20 Hz to 120 Hz.

Once the adjustment has been made, the same adjustment is done again for the loudspeaker 15.

Thus, the loudspeakers 14 and 15 absorb soundwaves at the frequencies concerned, thereby minimizing standing waves in the room.

In order to enable the loudspeakers 14 and 15 to absorb soundwaves effectively in the frequency range 20 Hz to 120 Hz, these loudspeakers are of the closed type and they have a resonant frequency situated outside said frequency range. The resonant frequency of these closed loudspeakers should be situated below 20 Hz or above 120 Hz. In practice, a resonant frequency may be situated at about 150 Hz.

Figure 4:
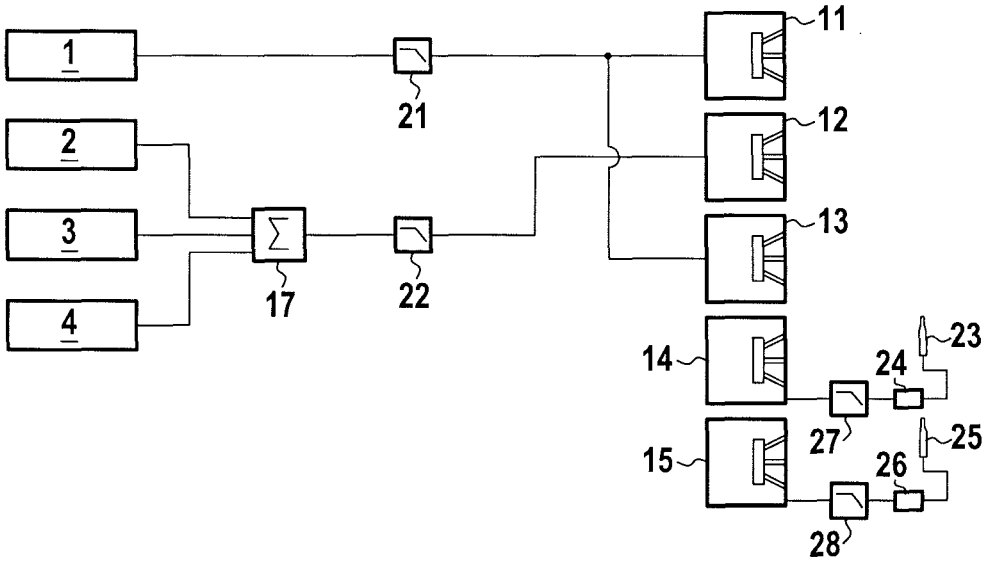
FIG. 4 is a diagram showing the various connections of a device of the invention in a second embodiment.

In a second embodiment of the invention as shown in FIG. 4, the bass effects signal 1 is filtered with a lowpass function at the cutoff frequency by the filter 21, and it drives simultaneously the loudspeakers 11 and 13 that are specialized for reproducing low frequencies.

As in the first embodiment of the invention, the frequencies lower than the cutoff frequency and contained in the signals 2, 3, and 4 are reproduced as follows: the signals 2, 3, and 4 are summed with the help of a summing device 17. The sum of the signals 2, 3, and 4 is then filtered with a lowpass function by the filter 22, and then drives the loudspeaker 12 specialized for reproducing low frequencies.

It is possible to use a plurality of loudspeakers 12 that are driven by the same signal without going beyond the ambit of the present invention, however this variant is not shown.

Two microphones 23 and 25 are arranged in the immediate proximity of the loudspeakers 14 and 15 respectively. The distance between each microphone and the corresponding loudspeaker must be less than half the minimum dimension of the loudspeaker, and said microphone must be placed in front of the sound-emitting portion of the loudspeaker.

The microphones 23 and 25 drive respective preamplifiers 24 and 26 suitable for transforming the signals produced by the microphones into signals that can be amplified directly by an amplifier. The preamplifiers 24 and 26 include polarity inverter devices that are used in the context of the present invention.

In an alternative, polarity may be inverted in the microphone or in the loudspeakers 14 and 15. The overall electroacoustic system constituted by a microphone, a preamplifier, an amplifier, and a loudspeaker should contain one and only one polarity inversion.

A lowpass filter 27, 28 is preferably provided between each preamplifier 24, 26. Such a filter 27, 28 is preferably adjusted to reject frequencies higher than 200 Hz, this frequency constituting a second cutoff frequency. This said second cutoff frequency may be reduced to a lower frequency, where necessary, in order to adapt better to the sound environment of the room.

The device as described for this second embodiment of the invention is used with the help of a spectrum analyzer by using the test signal supplied by said analyzer to drive anyone of the signals 2, 3, or 4. The sound pressure in the immediate proximity of the loudspeaker 14 is measured. The distance between the measurement microphone and the loudspeaker must be less than half the minimum dimension of the loudspeaker, and said microphone must be placed in front of the sound-emitting portion of the loudspeaker. Thereafter, the level of the loudspeaker 14 is adjusted so that the sound pressure is at a minimum in the range 20 Hz to 120 Hz.

Since the signals 2, 3, and 4 also drive loudspeakers (not shown) reproducing the majority of the sound spectrum, the "central" loudspeaker that has reproduced the signal 3 is driven with the test signal supplied by the analyzer. Said second cutoff frequency is then adjusted in the range 120 Hz to 200 Hz so as to obtain a minimum sound level in this frequency range.

The same method is then used again for adjusting the loudspeaker 15.

As a result, soundwaves at frequencies lying in the range 20 Hz to 200 Hz are absorbed in the immediate proximity of the loudspeakers 14 and 15 in the corners of the room opposite from the corners occupied by the loudspeakers 11 and 13. In a rectangular room, these corners are the locations where standing waves are at their greatest concentration, so the absorption provided by the loudspeakers 14 and 15 is the most effective.

It should be observed that in the context of the invention, the second embodiment is considered as being preferred.

The embodiments given in the present description are non-limiting examples of the invention, which is defined by the following claims.

The invention claimed is:

1. A method of reproducing low frequency sound in a rectangular room for reproducing sound from audio signals via at least three "main" channels and a "bass effects" channel in association with a video playback screen, which method comprises using at least five loudspeakers specialized in reproducing audio frequencies lower than 120 Hz, placing four loudspeakers selected from said at least five loudspeakers in four respective corners of said rectangular room, and placing at least one loudspeaker selected from said at least five loudspeakers in the proximity of said video playback screen, the method being characterized by selecting from said four loudspeakers first and second loudspeakers that are arranged in corners of said rectangular room that are furthest away from said video playback screen, configuring said first and second loudspeakers in such a manner that they receive a signal constituted by the sum of the signals for the other loudspeakers but with inverted polarity, with individual delays, and lowpass filtering and choosing said first and second loudspeakers in such a manner that they have a resonant frequency higher than 120 Hz.

2. A method according to claim 1, wherein said first and second loudspeakers (14, 15) have a resonant frequency of approximately 150 Hz.

3. A method according to claim 1, wherein said first and second loudspeakers are of closed type.

4. A method according to claim 1, wherein said third and second loudspeakers are selected from among said four loudspeakers, the third and fourth loudspeakers being arranged in corners of said rectangular room that are the closest to said video playback screen, and said third and fourth loudspeakers are adapted to receive a "low frequency effects" signal in its initial polarity and do not receive left, center, or right signals.

5. A method according to claim 1, wherein said at least one loudspeaker arranged in the proximity of said video playback screen is adapted in such a manner as to receive a lowpass filtered signal constituted by the sum of the left, center, and right main signals and not to receive the "low frequency effects" signal.

6. A device for reproducing low frequency sound in a rectangular room for reproducing sound from audio signals via at least three "main" channels and a "bass effects" channel in association with a video playback screen, which method comprises using at least five loudspeakers specialized in reproducing audio frequencies lower than 120 Hz, four loudspeakers selected from said at least five loudspeakers being arranged respectively in four corners of said rectangular room, and at least one loudspeaker selected from said at least five loudspeakers being arranged in the proximity of said video playback screen, the device being characterized in that wherein first and second loudspeakers that are arranged in corners of said rectangular room that are the furthest away from said video playback screen are selected from said four loudspeakers, which first and second loudspeakers are configured to receive a signal constituted by the sum of the signals allocated to the other loudspeakers with polarity inversion, with individual delays, and with lowpass filtering said first and second loudspeakers having a resonant frequency greater than 120 Hz.

7. A device according to claim 6, wherein said first and second loudspeakers have a resonant frequency of approximately 150 Hz.

8. A device according to claim 6, wherein said first and second loudspeakers are of closed type.

9. A device according to claim 6, wherein third and fourth loudspeakers that are arranged in corners of said rectangular room that are the closest to said video playback screen are selected from among said four loudspeakers, which third and fourth loudspeakers are adapted so that they receive a "low frequency effects" signal with its initial polarity and they do not receive left, center, or right signals.

10. A device according to claim 6, wherein said at least one loudspeaker arranged in the proximity of said video playback screen is adapted in such a manner as to receive a lowpass filtered signal constituted by the sum of the left, center, and right main signals and does not receive a "low frequency effects" signal.

* * * * *